United States Patent [19]

Suzuki et al.

[11] Patent Number: 4,757,176

[45] Date of Patent: Jul. 12, 1988

[54] CONTROL CIRCUIT FOR INDUCTION HEATING ELECTRIC COOKER

[75] Inventors: Toshio Suzuki, Kanagawa; Yoshihiro Sugimoto, Tokyo, both of Japan

[73] Assignee: Sony Corporation, Tokyo, Japan

[21] Appl. No.: 15,982

[22] Filed: Feb. 18, 1987

[30] Foreign Application Priority Data

Feb. 19, 1986 [JP] Japan ..... 61-32846

[51] Int. Cl.[4] ..... H05B 6/06

[52] U.S. Cl. ..... 219/10.77; 219/494; 219/510; 219/10.493; 99/325

[58] Field of Search ..... 219/10.49 R, 10.77, 219/10.75, 494, 497, 510; 99/325, DIG. 14

[56] References Cited

U.S. PATENT DOCUMENTS 3,781,506 12/1973 Ketchum et al. ..... 219/10.77 X
4,381,438 4/1983 Goessler et al. ..... 219/10.49 R
4,456,807 6/1984 Ogino et al. ..... 219/10.77
4,464,553 8/1984 Ikeda ..... 219/10.77
4,467,165 8/1984 Kiuchi et al. ..... 219/10.77
4,638,135 1/1987 Aoki ..... 219/10.49 R

FOREIGN PATENT DOCUMENTS 53-55866 5/1978 Japan .

*Primary Examiner*—Philip H. Leung
*Attorney, Agent, or Firm*—Hill, Van Santen, Steadman & Simpson

[57] ABSTRACT

An output controlling device for an electric cooker which fully utilizes the capacities of electric cooker parts when the electric cooker is used at an ordinary temperature and which improves the convenience of the electric cooker in use. The output controlling device controls the input power to the electric cooker to temporarily increase the input power and then return it to its normal value before the temperature of a part of the cooker reaches a maximum allowable temperature.

16 Claims, 2 Drawing Sheets

CONTROL CIRCUIT FOR INDUCTION HEATING ELECTRIC COOKER

BACKGROUND OF THE INVENTION

1. Field of the Invention

The present invention relates to an output controlling device for controlling an electric cooker.

2. Description of the Related Art

Conventional electric cookers are widely known wherein power is supplied to an electric heating coil to heat a pot or pan placed above the heating coil by induction (refer to Japanese patent laid-open No. 53-55866). Such an electric cooker has a relatively high power rating among common home electric appliances and a part thereof is, thus, heated considerably. Therefore, an electric cooker is normally designed such that the temperature of key parts do not exceed a maximum allowable temperature even if the electric cooker is used at high environmental temperatures such as, for example, at a room temperature of 40 degrees Centigrade.

In this manner, an electric cooker is normally designed for a maximum allowable temperature of parts thereof. Accordingly, when the electric cooker is used at ordinary temperatures (for example, 20 degrees Centigrade or so), it will operate at a considerably lower temperature. In other words, the electric cooker does not make the most of heating capabilities of its parts when it is used at ordinary temperatures.

SUMMARY OF THE INVENTION

It is an object of the present invention to provide an output controlling device for an electric cooker which enables the parts of the cooker to be used to capacity to a satisfactory degree and to improve the convenience of the electric cooker in use.

In order to attain the object, according to the present invention, there is provided an output controlling device for an electric cooker of the type which controls the output of the cooker by controlling input power to the cooker. The device includes a temperature detecting means for detecting the temperature of a cooker part which changes in temperature in accordance with the magnitude of the input power to the electric cooker. A power increasing means for increasing the input power, and a power controlling means operable in response to a detection output of the temperature detecting means for controlling the input power to return to its normal value before the temperature of the detected cooker part reaches a maximum allowable temperature, are also included.

Thus, according to the invention, the input power to the electric cooker is increased temporarily, such as when the cooker is first turned on, and then decreased to its normal value before the temperature of cooker parts which is caused to rise by such temporary increase in the input power reaches the maximum allowable temperature. Faster heating of articles by the cooker is thus provided, while not exceeding the allowable temperature limits of the parts of the cooker.

DESCRIPTION OF THE PREFERRED EMBODIMENTS

Now, a preferred embodiment of the present invention will be described in detail with reference to the accompanying drawings.

Figure 1:
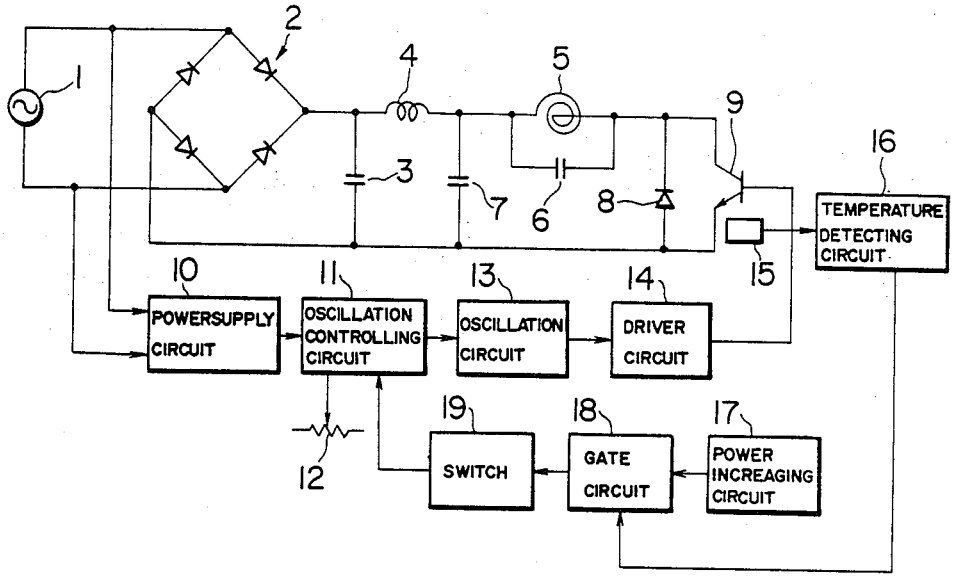
FIG. 1 is a circuit and block diagram showing generally an electric cooker in which an output controlling device according to an embodiment of the present invention is incorporated.

FIG. 1 is a block circuit diagram showing construction of an electric cooker in which an output controlling device according to the present invention is incorporated. Referring to FIG. 1, an AC power source 1 is connected to a pair of input terminals of a diode bridge 2 which has a pair of output terminals connected to opposite ends of a capacitor 3 to produce a rectified output. One end of the capacitor 3 is connected to a choke coil 4 for high frequency blocking which is in turn connected to a parallel circuit including a work coil, or heating coil, 5 at which the output of the electric cooker is provided and a capacitor 6 for resonance. A capacitor 7 is also provided for filtration. The parallel circuit including the work coil 5 and the capacitor 6 is connected to a diode 8 for damping and an output transistor 9.

The AC power source 1 is also connected to a power supply circuit 10, an output of which is supplied to an oscillation controlling circuit 11. The oscillation controlling circuit 11 provides a signal in the form of a voltage, the level of which is set by a variable resistor 12, to an oscillation circuit 13. Upon receiving the output signal of the oscillation controlling circuit 11, the oscillation circuit 13 develops therefrom a square wave signal having a repetition frequency corresponding to the received signal. The square wave signal from the oscillation circuit 13 is supplied to the base of the output transistor 9 via a driver circuit 14 to control the transistor 9 to repetitively turn on and off. A pot or pan placed above the work or heating coil 5 is, thus, heated by induction as the output transistor 9 is repetitively switched on and off in this manner.

A temperature detecting element 15 such as, for example, a thermistor which serves as a temperature detecting means is mounted on a cooling body (not shown), such as a heat sink, of the output transistor 9. The output of the temperature detecting element 15 is coupled to a temperature detecting circuit 16 which detects the temperature of the cooling body of the output transistor 9. Thus, the temperature of the output transistor 9 is detected indirectly. A power increasing circuit 17 serving as a power increasing means develops an output which is delivered to the oscillation controlling circuit 11 via a gate circuit 18 and a manual switch 19. The gate circuit 18 is controlled to open or close in response to the output of the temperature detecting circuit 16 and, thus, serves as a power controlling means. The output of the power increasing circuit 17, when received by the oscillation controlling circuit 11, effectively raises the upper limit value of a voltage variation range provided by the variable resistor 12. As a result, the oscillation frequency of the oscillation circuit 13 decreases and the input power increases. The oscillation frequency of the oscillation circuit 13 of the present embodiment determines what portion of a maximum possible input power is supplied as input power to the cooker. For example, the pulse duration of the square wave is fixed and variations in frequency change the spacing between the square wave pulses. Here, the temperature of the output transistor 9 varies in response to the magnitude of the input power. Meanwhile, the output of the temperature detecting circuit 16 causes the gate circuit 18 to open to return the input power to its normal value before the temperature of the cooling body of the output transistor 9 which is caused to rise by the increased power reaches an allowable highest or maximum temperature.

Now, use of the electric cooker having the construction as described above at an ordinary temperature (for example, 20 degrees centigrade or so) will be described. Normally, the switch 19 is off and accordingly the upper limit of the voltage variation range established by the variable resistor 12 assumes an ordinary value. A square wave signal having a repetition frequency determined by the setting of the variable resistor 12 is generated by the oscillation circuit 13 and received by the output transistor 9 which turns on and off in response to the received square wave signal. Thus, electric current flows in the work, or heating, coil 5 in response to the on and off switching of the output transistor 9 so that a pot or pan placed above the work coil 5 is heated by induction. In such ordinary use, for example, the input power is $P_0$, and the temperature of the cooling body of the output transistor 9 rises as time passes and finally reaches and focuses upon a temperature $T_N$ as shown by a curve A in FIG. 2.

Meanwhile, if the switch 19 is turned on at a time $t_0$ corresponding to starting use of the electric cooker, the output of the power increasing circuit 17 is delivered to the oscillation controlling circuit 11 via the gate circuit 18 and the switch 19. Consequently, the upper limit value of the voltage variation range as determined by the variable resistor 12 rises. As a result, the oscillation frequency, that is, the repetition frequency of the square wave signal developed from the oscillation circuit 13 lowers and the input power to the electric cooker increases. The input power then becomes, for example, $P_1$ (where $P_1 > P_0$), and the change in temperature of the cooling body of the output transistor 9 provides a more sharply changing curve relative to the curve A, as shown by a curve B in FIG. 2. Then, in response to the output of the temperature detecting circuit 16, the gate circuit 18 is opened at a time $t_1$ just before the temperature of the cooling body of the output transistor 9 reaches a maximum allowable temperature $T_{MAX}$. Consequently, the original repetition frequency of the square wave signal from the oscillation circuit 13 is restored so that the input power is returned to its ordinary value $P_0$. Accordingly, after the time $t_1$, the temperature lowers gradually and focuses finally to a final temperature $T_N$ for ordinary use of the electric cooker.

Figure 2:
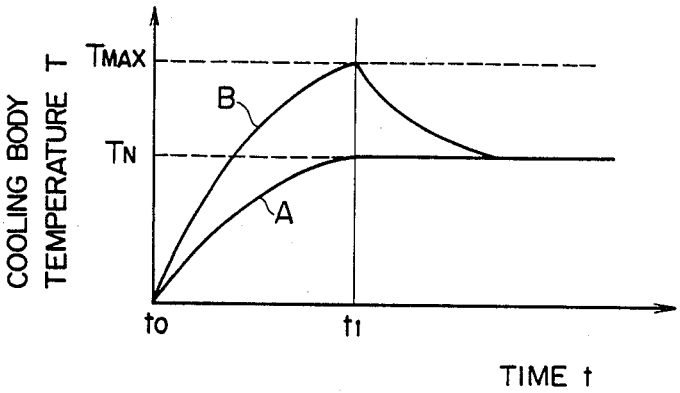
FIG. 2 is a graph showing changes in temperature over time of a cooling body of a transistor.

In this manner, if the switch 19 is turned on, then the state $P_1$ in which the input power is increased continues for a period of time until just before the temperature of the cooling body of the output transistor 9 reaches the maximum allowable temperature $T_{MAX}$, that is, for a period of time from $t_0$ to $t_1$ as shown in FIG. 2. Accordingly, when, for example, it is desired to boil water rapidly, water can be boiled earlier compared with a time required when the electric cooker operates with normal input power $P_0$. Thus, the electric cooker is very convenient in use. Should the environmental temperature atmosphere rise for some reason, the period during which the input power is increased will become shorter, but the temperature of the cooling body of the output transistor 9 will never exceed the maximum allowable temperature $T_{MAX}$. Consequently, the reliability of the output transistor 9 will not be deteriorated.

It will be appreciated that the temperature detecting element 15 may otherwise be mounted directly on the output transistor 9, or at some other temperature responsive portion of the cooker.

Figure 3:
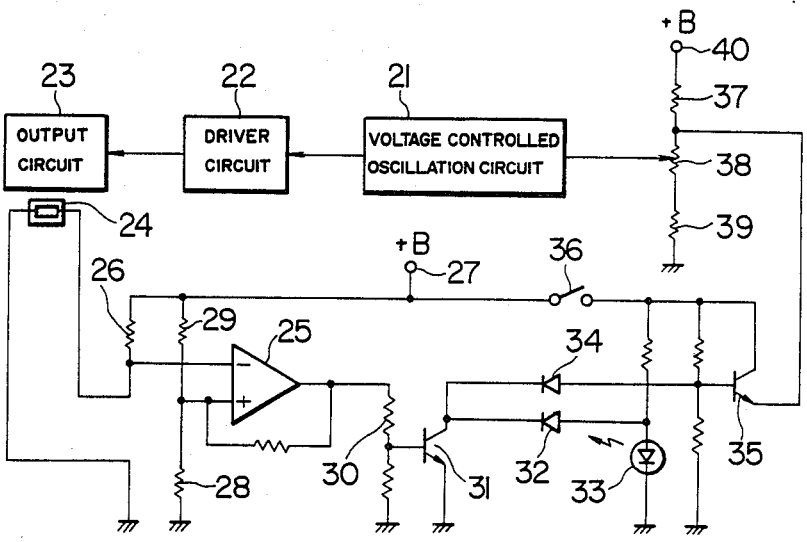
FIG. 3 is a circuit and block diagram showing details of circuit construction of an essential part of the electric cooker shown in FIG. 1.

A detailed construction of an essential part of the output controlling circuit that is described above will be described with reference to FIG. 3. A voltage controlled oscillation circuit (VCO) 21, which corresponds to the oscillation circuit 13 described above, is connected to a driver circuit 22, which corresponds to the driver circuit 14 described above. The driver circuit 22 is connected to an output circuit 23 which corresponds to an output circuit section including the work coil 5, the output transistor 9 and so on. A thermistor 24 corresponds to the temperature detecting element 15 described above and has one end grounded and the other end connected to a power supply terminal 27 via an inverting input terminal of a voltage comparator 25 and a resistor 26, the comparator 25 corresponding to the temperature detecting circuit 16 described above. A non-inverting input terminal of the voltage comparator 25 is grounded via a resistor 28 and connected to the power supply terminal 27 via another resistor 29. An output terminal of the voltage comparator 25 is connected to the base of a transistor 31, corresponding to the gate circuit 18 described above, via a resistor 30. The collector of the transistor 31 is connected to a light emitting diode 33 via a diode 32 and also to the base of another transistor 35, corresponding to the power increasing circuit 17 described above, via another diode 34. The light emitting diode 33 provides an indication. The collector of the transistor 35 and the light emitting diode 33 are connected to the power supply terminal 27 via a switch 36, which corresponds to the switch 19 described above. The emitter of the transistor 35 is connected to a junction point between a variable resistor 38 and a resistor 37 in a series circuit which includes the resistor 37, the variable resistor 38 and a further resistor 39. The resistor 37 is connected to another power supply terminal 40 while the variable resistor 38 is connected to the voltage controlled oscillation circuit 21. The variable resistor 38 may be integrated, for example, with the switch 36 such that the switch 36 is turned on at a click position of the variable resistor 38 to which the variable resistor 38 is moved farther than a maximum level of the adjustment range.

In the electric cooker having the above-described construction, if the switch 36 is turned on, the light emitting diode 33 is lit to indicate that the electromagnetic cooker is operating to increase the input power thereof. Now, if use of the electric cooker at ordinary temperatures is considered, the output of the voltage comparator 25 is at a low level and hence the transistor 31 is off while the transistor 35 is on. Accordingly, the upper limit value of the variation voltage range for the variable resistor 38 is caused to rise by the operation of the transistor 35, and consequently the voltage supplied to the voltage controlled oscillation circuit 21 rises so that the oscillation frequency of the voltage controlled oscillation circuit 21 is lowered and the input power to the electromagnetic cooker is increased. The temperature of the cooling body of the output transistor in the output circuit 23 rises so that the resistance of the thermistor 24 lowers, and just before the temperature of the cooling body reaches the maximum allowable temperature, the output of the voltage comparator 25 changes state to turn the transistor 31 on and the transistor 35 off. Consequently, the light emitting diode 33 is extinguished, and the oscillation frequency of the voltage controlled oscillating circuit 21 is returned to its original oscillation frequency. The input power is thereby returned to its normal value.

When the switch 36 is off, operation within the normal variation range by the variable resistor 38 is maintained.

It will be appreciated that the temperature of the work coil or the damper diode may be detected instead of the temperature of the output transistor. Further, it is also possible to detect a change in temperature from a change in the base-emitter voltage $V_{BE}$ of the output transistor.

As apparent from the foregoing description, in an output controlling device for an electric cooker according to the present invention, the input power is increased temporarily and then returned to its ordinary value before the temperature of a part reaches a maximum allowable temperature. Accordingly, operating capacities of the cooker parts are used to their fullest in the electric cooker at normal temperatures, without deteriorating the reliability of the parts. In addition, when a higher output is required, for example, when it is desired to boil water rapidly, water can be boiled sooner compared to the time required when the electric cooker is operating at a normal input power. In this manner, the convenience of an electric cooker in use is improved.

Although other modifications and changes may be suggested by those skilled in the art, it is the intention of the inventors to embody within the patent warranted hereon all changes and modifications as reasonably and properly come within the scope of their contribution to the art.

We claim as our invention:

1. An output controlling device for controlling an electric cooker by controlling input power to the electric cooker, the electric cooker having a part in an output circuit changeable in temperature in response to changes in the magnitude of input power to the electric cooker, comprising:

a temperature detecting means for detecting the temperature of said part in said output circuit of said electric cooker and having a detection output for providing a temperature detection signal;

a power increasing means for increasing input power to said electric cooker above a predetermined normal value to cause faster heating by said electric cooker and an increase in the temperature of said part; and a power controlling means responsive to said detection signal of said temperature detecting means for controlling input power to return to said predetermined normal value from an increased input power level before the temperature of said part in said output circuit that is rising as a result of said power increasing means reaches a predetermined maximum allowable temperature.

2. An output controlling device as claimed in claim 1, wherein said power controlling means includes a manually operable means for enabling said power increasing means to start increasing input power.

3. An output controlling device as claimed in claim 2, further comprising:

a voltage adjusting means associated with said manually operable means of said power controlling means for developing an adjusted voltage to control the output of said electric cooker.

4. An output controlling device as claimed in claim 1, further comprising:

a voltage controlled oscillation circuit, and an oscillation controlling circuit providing an adjusted voltage to said voltage controlled oscillation circuit.

5. An output controlling device as claimed in claim 4, wherein said oscillation controlling circuit includes an adjustable means for setting an output voltage in a variation voltage range of said oscillation controlling circuit and is associated with said power controlling means such that an upper limit value of the variation voltage range of said oscillation controlling circuit provided by said adjustable means may be changed by an output of said power controlling means.

6. An output controlling device as claimed in claim 5, wherein said power controlling means is operable in response to said temperature detection signal on said detection output of said temperature detecting means to enable said power increasing means to cause said oscillation controlling circuit to provide a voltage to increase the output power of said electric cooker.

7. An output controlling device as claimed in claim 4, wherein said power controlling means includes a manually operable means for enabling said power increasing means to start increasing the input power, said power increasing means being disabled in response to said temperature detection signal on said detection output of said temperature detecting means.

8. An output controlling device as claimed in claim 1, further comprising:

means for indicating that said power increasing means is operating to increase the output of said electric cooker.

9. An output controlling device as claimed in claim 1, wherein said part in said output circuit is an output transistor.

10. An output controlling device as claimed in claim 1, wherein said part in said output circuit is a heat sink for an output transistor.

11. An output controlling device as claimed in claim 1, wherein said part in said output circuit is a heating coil of the electric cooker.

12. An output controlling device as claimed in claim 1, wherein said part in said output circuit is a damper diode.

13. A control circuit for an electric cooker having a heating coil and at least one part in an output circuit varying in temperature upon changes in input power to the electric cooker, comprising:

a temperature sensor responsive to the temperature of said at least one part in said output circuit;

means for increasing input power to said electric cooker above a predetermined normal input power level; and means for selectively controlling said power increasing means to increase input power to said electric cooker above said predetermined normal input power level, said selectively controlling means being responsive to said temperature sensor to return input power to said electric cooker to the predetermined normal level before the temperature of said at least one part reaches a predetermined maximum temperature.

14. A control circuit for an electric cooker having a heating coil and a part in an output circuit changing in temperature upon changes in input power to the heating coil, comprising:

a temperature sensor mounted to detect temperature changes of said part in said output circuit;

means for selectively temporarily increasing input power to said heating coil to increase the temperature of said part as sensed by the temperature sensor and to reduce the time for heating of articles by said heating coil; and means for reducing input power to said heating coil to a predetermined normal level by inhibiting said temporarily increasing input power before said part reaches a predetermined maximum temperature of said part as sensed by said temperature sensor.

15. A control circuit as claimed in claim 14, further comprising:

means for selectively varying input power to said heating coil responsive to a predetermined signal range, and wherein said power increasing means includes means for selectively increasing an upper limit of said signal range until before the maximum temperature is sensed.

16. A control circuit as claimed in claim 14, further comprising:

an indicator connected to indicate when said power increasing means is operating.

* * * * *